US009232295B2

(12) United States Patent
Kukurudza

(10) Patent No.: US 9,232,295 B2
(45) Date of Patent: Jan. 5, 2016

(54) EAR CANAL EAR BUD SOUND SYSTEM

(76) Inventor: Vladimir Walter Kukurudza, Toronto (CA)

( * ) Notice: Subject to any disclaimer, the term of this patent is extended or adjusted under 35 U.S.C. 154(b) by 334 days.

(21) Appl. No.: 13/986,133

(22) PCT Filed: Oct. 6, 2011

(86) PCT No.: PCT/CA2011/001119

§ 371 (c)(1),
(2), (4) Date: Apr. 4, 2013

(87) PCT Pub. No.: WO2012/048406

PCT Pub. Date: Apr. 19, 2012

(65) Prior Publication Data

US 2014/0301560 A1 Oct. 9, 2014

(30) Foreign Application Priority Data

Oct. 12, 2010 (CA) ..... 2717411

(51) Int. Cl.
*H04R 1/10* (2006.01)
*G10K 11/178* (2006.01)
*H04R 1/02* (2006.01)

(52) U.S. Cl.
CPC ..... *H04R 1/1083* (2013.01); *G10K 11/178* (2013.01); *H04R 1/023* (2013.01); *H04R 1/1016* (2013.01)

(58) Field of Classification Search
CPC ..... H04R 5/04; H04R 5/033; H04R 1/1016; H04R 3/00; H01F 19/00; G10K 11/178; G10K 11/1782; G10K 11/1784; G10K 11/1786; G10K 11/1788
USPC ..... 381/309, 94.1, 94.6, 94.9, 380, 381, 381/384, 184–186, 328, 150, 345, 162, 351
See application file for complete search history.

(56) References Cited

U.S. PATENT DOCUMENTS

| | | | | |
|---|---|---|---|---|
| 4,300,022 | A * | 11/1981 | Hastings-James et al. | 381/121 |
| 5,373,563 | A * | 12/1994 | Kukurudza | 381/94.9 |
| 5,519,781 | A * | 5/1996 | Kukurudza | 381/94.9 |
| 5,615,272 | A * | 3/1997 | Kukurudza | 381/117 |
| 5,917,922 | A * | 6/1999 | Kukurudza | 381/94.9 |
| 6,137,379 | A * | 10/2000 | Morrill | 333/169 |
| 2002/0130752 | A1* | 9/2002 | Kuroshima et al. | 336/200 |
| 2003/0202664 | A1* | 10/2003 | Brodkin | 381/1 |
| 2004/0151334 | A1* | 8/2004 | Vaudrey et al. | 381/322 |
| 2005/0078848 | A1* | 4/2005 | Hlibowicki | 381/401 |
| 2007/0098189 | A1* | 5/2007 | Kukurudza | 381/117 |
| 2008/0025543 | A1* | 1/2008 | Wang et al. | 381/334 |

(Continued)

FOREIGN PATENT DOCUMENTS

| | | | |
|---|---|---|---|
| CA | 2822822 | A1 * | 2/2015 |
| JP | 58225798 | A * | 12/1983 |

(Continued)

*Primary Examiner* — John Villecco

(57) ABSTRACT

An earbud sound system for a small speaker system having at least one earbud with a speaker and having, an earbud housing body defining a hollow interior a a circuit board within the housing body and having a signal input connection and a ground connection, and a speaker output connection and a speaker return connection; a bifilar coil unit having first and second coils wound in a bifilar manner, mounted on the circuit board within the housing body, and there being two first coil connections, and two second coil connections on the circuit board, for supporting the bifilar coil unit in a secure manner on the circuit board.

9 Claims, 4 Drawing Sheets

(56) References Cited

U.S. PATENT DOCUMENTS

| | | | | |
|---|---|---|---|---|
| 2009/0010461 | A1* | 1/2009 | Klinghult et al. | 381/309 |
| 2012/0045079 | A1* | 2/2012 | Kukurudza | 381/300 |
| 2012/0224717 | A1* | 9/2012 | Teng | 381/94.1 |
| 2013/0259271 | A1* | 10/2013 | Miyoshi et al. | 381/151 |
| 2013/0327202 | A1* | 12/2013 | Mills | 84/726 |

FOREIGN PATENT DOCUMENTS

| | | | | |
|---|---|---|---|---|
| JP | 2003236469 | A | * | 8/2003 |
| WO | WO 9525413 | A1 | * | 9/1995 |
| WO | WO 9837732 | A1 | * | 8/1998 |
| WO | WO 2010/096905 | A1 | | 9/2010 |

* cited by examiner

EAR CANAL EAR BUD SOUND SYSTEM

FIELD OF THE INVENTION

The invention relates to an Ear Canal Earbud Sound System, such as is used with small portable audio player systems, the head set having at least one earbud of the kind which fits partially within the ear canal, and having a noise suppression circuit on a compact circuit board incorporated withing the earbud. The circuit provides a reduction in noise induced in conventional speaker circuits, and enhances sound quality.

BACKGROUND OF THE INVENTION

Ear Canal Earbud Sound Systems, such as are used in head sets, especially of the type used in portable audio devices, such as audio players, cell phones, and in some cases in security systems head sets, and military systems, and possibly also in hearing aids, are of compact minimal size, for obvious reasons.

As a result, even though the audio quality of the actual signal may be adequate, the quality of the audio sound delivered by the speakers is often much less than is possible or desirable. This is partly due to the limitations imposed in the design by the small size of the speakers themselves.

The sound quality may be much less, where there is a noisy environment or where transmission is poor.

It is found that much of the loss of quality is due to noise induced in the speaker circuits. If this induced noise can be reduced or eliminated then the audio quality of the sound from the speakers will be both much higher, and of greater clarity.

The signals may come from sources such as tape, CD, or memory chip, or may be communication signals such as mobile phones, radio communication, or possibly hearing aids.

The audio signals may be stereo sound signals. These stereo signals are supplied as left and right hand signals. Audio signals include what can be broadly described as combining both high, medium, and low frequencies. Circuits usually provided in such ear bud speakers for this purpose are usually miniature in scale and somewhat primitive. The speakers themselves also incorporate speaker coils, and these coils are believed to contribute to the electronic noise. It is of course common place that such headsets incorporate a wire harness consisting of a pair of wires connecting to the source of audio signals, and ear buds are then connected by separate wires, one wire for each ear, each of those earbuds incorporating a speaker. In many cases the earbuds actually fit at least partially within the ear canal. In other cases they are held in some form of resilient headband, made of plastic or wire, which partially encircles the head and holds the two earbuds against the two ears.

In prior U.S. Pat. Nos. 5,615,272, and 5,519,781 and Canadian Patent 2,192,163. Inventor V. W Kukurudza, there are disclosed noise suppression circuits incorporating special "bifilar" wound coils. These bifilar coils actually comprise two coils in one. Bifilar coils consist basically of a pair of wires with the two strands wound into double coils with wire strands of one coil alternating with wire strands of the other coil. Such a bifilar coil is used in each noise suppression circuit. The bifilar coils produce a substantial reduction in electronic noise in the circuit. The bifilar coils also help to reduce the electronic noise originating in the speakers themselves.

To provide a miniaturized noise suppression circuit with such bifilar coils, of an extremely compact size, for use in the Ear Canal Earbud Sound System having the type of head sets or speaker systems described above, numerous other problems arise.

The bifilar coils develop significant internal stresses during operation. The coils must be secured so as to withstand these stresses. One approach is to provide a bifilar coil securely mounted on a single board, and the single board was located in the wire harness, but not in the ear bud itself.

This approach has met with some success. However in this system it was necessary to mount the noise suppression circuit and bifilar coils in the main wire coming from the audio device itself, before the wire is divided into two to supply each earbud. This meant that the entire headset and wire harness must be re-engineered, leading to considerable extra expense. This may lead to a certain degree of customer resistance. Earbuds each incorporate a generally speaking hollow body, containing the miniature speaker, and connections for the wire harness to the speaker.

It is now considered desirable to provide an Ear Canal Earbud Sound System with two separate miniaturized noise suppression circuits each of which actually fit within the hollow interior of a respective earbud, and each being connected between the incoming wire harness connection, and the speaker itself, and back to ground.

In order to provide this extreme degree of miniaturization, the noise suppression circuits are preferably constructed on the smallest practicable circuit board so as to fit within an existing earbud housing.

Each board must be designed and specified so as to fit within the housing of the ear bud, and the housings should preferably fit at least partially within the ear canals of the user.

Boards of this size carrying such a complex circuit, and fitting in such a limited space simply do not exist.

BRIEF SUMMARY OF THE INVENTION

With a view to achieving a solution to these complex and conflicting problems the invention comprises an Ear Canal Earbud Sound System for a small speaker system characterised by at least one earbud with a speaker and having a circuit board with a signal input connection and a ground connection, and further having a speaker output connection and a speaker return connection, and further having a bifilar coil unit comprising input and return coils wound in a bifilar manner and having two input coil connections, and two return coil connections secured on the circuit board, supporting the bifilar coil in a secure manner, and securing the bifilar coil unit to the respective coil connections on said circuit board.

Preferably the invention provides an Ear Canal Earbud Sound System having the foregoing features and further having a forward circuit board side and a rearward circuit board side, with said signal input connection and ground connection arranged on said reaward side, and with said speaker supply connection and said speaker return connection at said forward side.

The invention also provides an Ear Canal Earbud Sound System with a head set having left and right Earbuds with respective speakers, and with respective compact noise suppression circuits incorporated in each of said left and right earbuds and a wire harness for connecting a portable audio reproduction device with a signal source such as a memory for source of audio signals.

According to a further embodiment the invention can be adapted for use with mon-aural audio signals. In this case there will only be a single earbud and a noise suppression circuit board, using a single bi-filar coil unit.

In accordance with a particularly advantageous feature of the invention, the headset will incorporate left and right hand earbud bodies, sized to fit partly within the ear canals of a user, each of the earbud bodies defining a hollow housing, and wherein a said noise suppression circuit is contained within each respective earbud hollow housing.

Preferably, in accordance with this feature, each earbud housing will be formed as first and second body portions, which are separable from one another to give access to the interior of said housing and wherein a said noise suppression circuit is fitted within one body portion of said housing, with the other portion of said housing secured to the first body portion, thereby enclosing the noise suppression circuit within the housing.

Preferably the invention provides a pair of earbuds, each having a hollow body defining an interior earbud housing, and a wire input opening in said hollow body for introducing wire, and axial opening at one end of said hollow body, an inwardly offset connection lip extending around said hollow body at said open end, a flexible, resilient earbud cushion, a cushion support member supporting said cushion, said cushion support member having an open end, and a recessed groove formed around the interior of said open end, for receiving said connecting lip of said hollow body and a microphone received within said support body, and connections connecting an earbud noise suppression circuit board to said microphone.

The invention further usefully includes an ear cushion support defining an extension in the form of a hollow tube, and an outwardly extending rim formed on said extension, for retaining said earbud cushion thereon, and the circuit board is circular and disk shaped, and fits within the hollow interior of the housing with the centre of the disk shaped circuit board aligned along the central axis of the hollow housing, and with the disk lying in a plane normal to the axis of the housing.

The various features of novelty which characterize the invention are pointed out with more particularity in the claims annexed to and forming a part of this disclosure. For a better understanding of the invention, its operating advantages and specific objects attained by its use, reference should be made to the accompanying drawings and descriptive matter in which there are illustrated and described preferred embodiments of the invention.

IN THE DRAWINGS

DESCRIPTION OF A SPECIFIC EMBODIMENT

As explained above, the invention provides an Ear Canal Earbud Sound System with a headset harness of the kind used with a wide variety of audio devices, and as also used in military, police and other equipment. Such systems are also used with dictating equipment. It is generally well known that the quality of sound reproduction in such miniature audio equipment and headset harnesses is of somewhat inferior quality. The present invention is directed to enhancing the quality of such sound reproduction, by incorporating sound enhancement circuits processing audio signals and located directly directly in the earbuds themselves.

Also by redesigning the speakers themselves to accept the processed audio signals further clarity is obtained.

Figure 1:
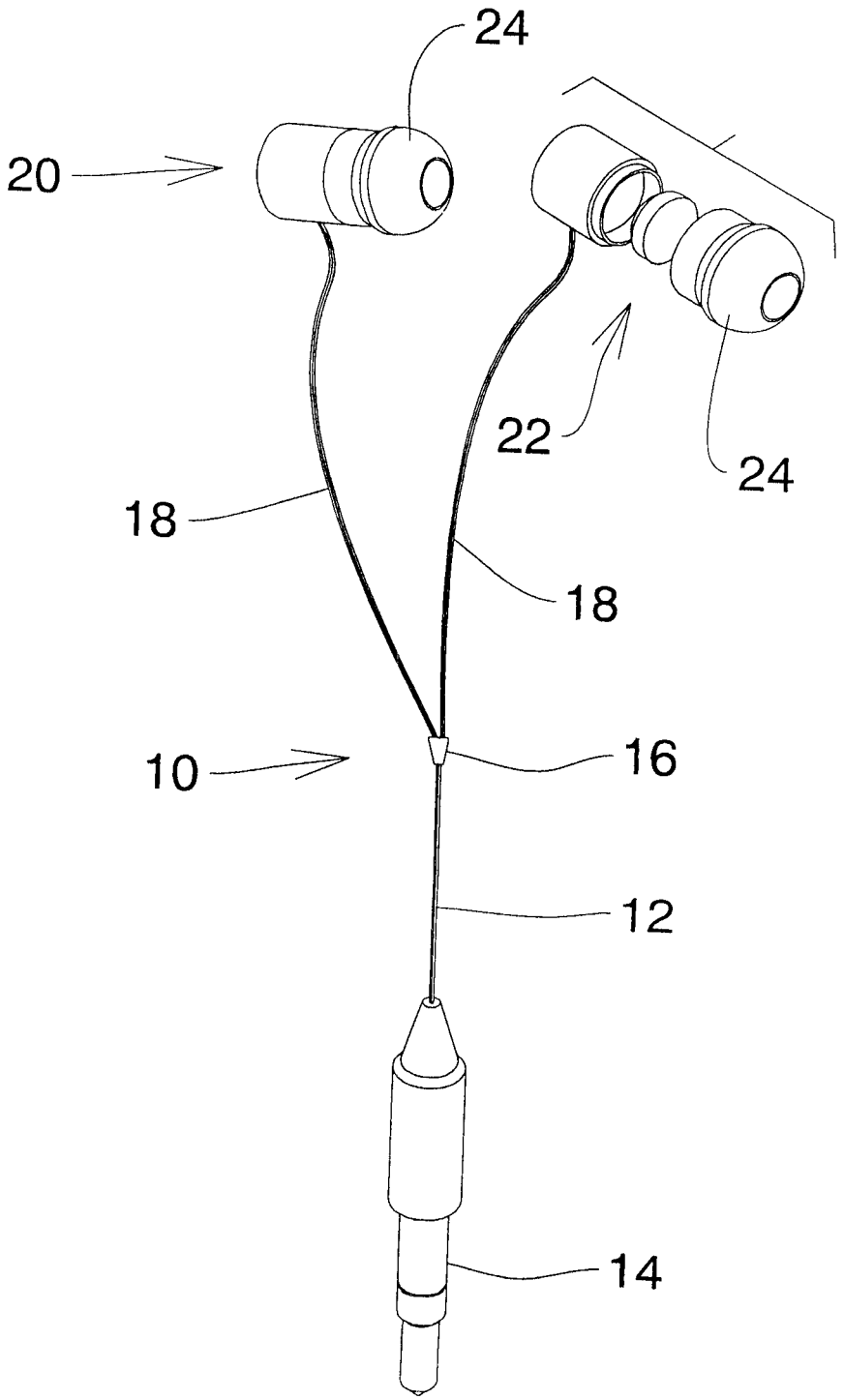
FIG. 1 is a schematic plan view of an Ear Canal Earbud Sound System headset harness for use with a typical small portable audio player device, having a pair of earbuds with speakers, and each having a compact noise suppression circuit illustrating the invention.

Accordingly, referring to FIG. 1, this illustrates a headset harness (10). A headset harness typically incorporates a single cable (12), having a plug (14) of the type fitting into a particular form of audio reproduction system, of whatever type may be in use. The cable (12) ends at connection (16), and within connection (16) the cable is then connected to two separate cables (18) and (18), going to respective left and right ears. Left and right hand earbuds (20) and (20) may simply be secured to the ends of their respective cables (18) and (18). Alternatively in some embodiments a resilient head clamp (not shown) may be provided for supporting one or both of the earbuds. In some systems for example, there may be only one earbud in use at any one time.

Such systems may be employed for example persons operating telephones, switchboards, or two way radios and so on.

Each of the earbuds, in the majority of cases, is provided with a flexible resilient ear cushion (24). The ear cushion (24) may be shaped so that it fits at least partly into the ear canal, and holds the earbud in position. Alternatively, the cushion may be somewhat larger and serve to exclude external noise in the environment where the person is working.

Figure 2:
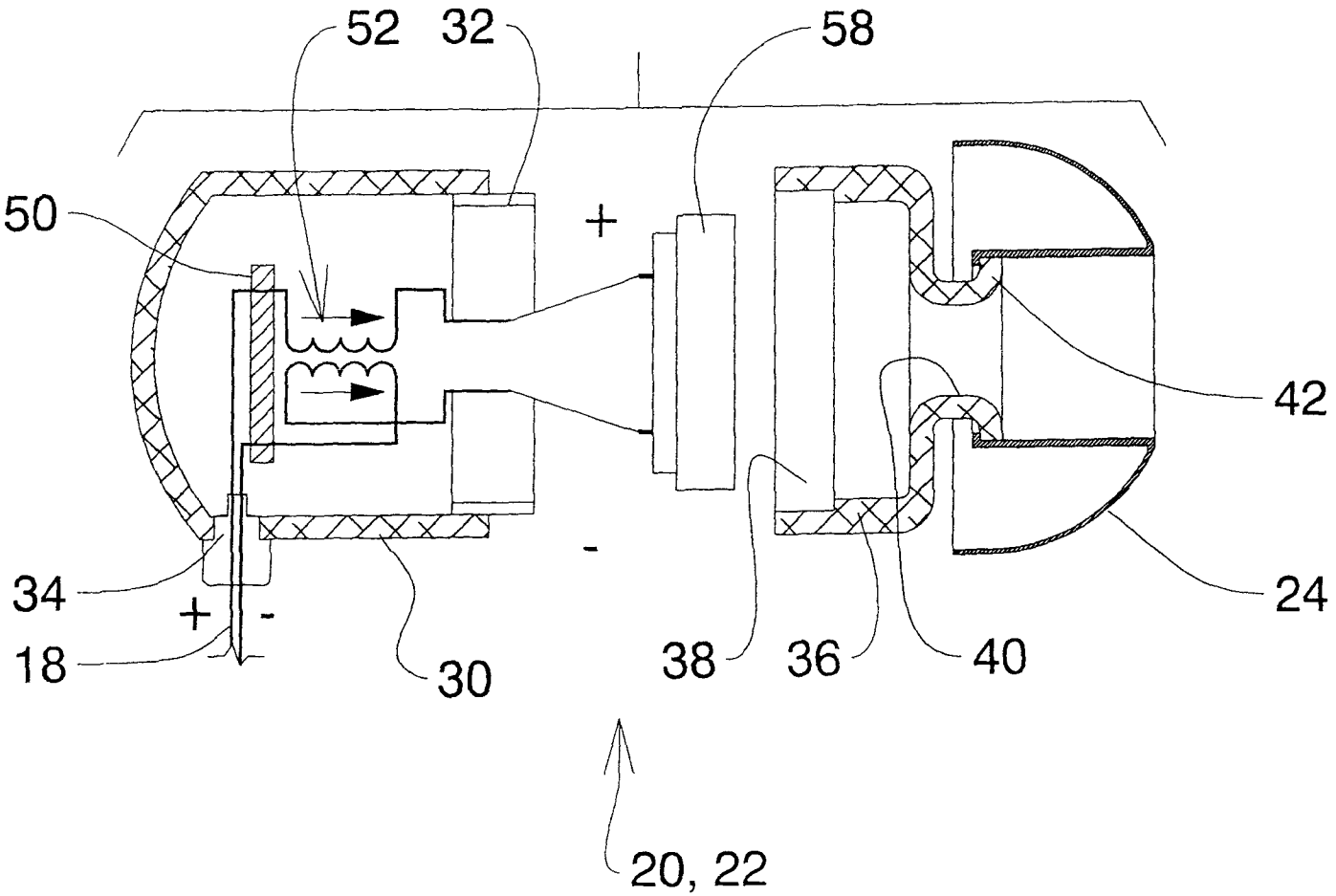
FIG. 2 is an exploded perspective of an earbud having a noise suppression circuit illustrating the invention showing two components of the earbud housing separated from one another and the noise suppression circuit located between them.

Referring now to FIG. 2, it will seem that each earbud comprises a first earbud body (30) which is in the form of a tubular hollow container and has an open end defined by an inward recessed junction lip (32). A small opening (34) allows the entry of a cable (18). A second earbud body portion comprises an ear cushion support (36) which is generally cup shaped and has an open end defined by an interior recessed ridge (38). The ridge (38) inter-fits with the lip (32) so as to form a closed housing. Typically they will be joined together by some form of bonding agent, adhesive or plastic solvent or the like. The ear cushion support (36) has a tubular extension (40), defining a hollow cylindrical interior and terminating in an outwardly extending tube (42). A cushion member (24) is snap fitted over the end of tube (42) and retained in position. As explained the cushion member may be either a soft relatively large cushion or may be a shaped smaller form of cushion, designed to be wedged in the outer end of the ear canal. The tube (42) is hollow and enables the transmission of sounds from the speaker to the user.

Within each body (30) there is located a miniaturized signal processing circuit board (50).

Figure 5:
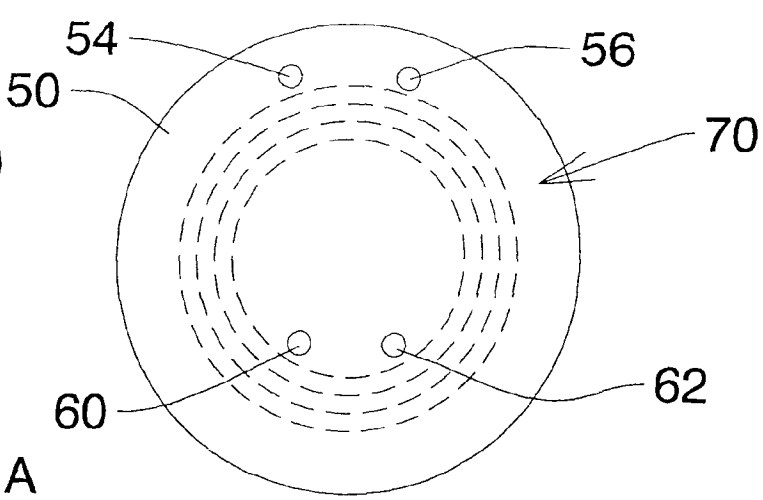
FIG. 5 is a top plan view of the circuit.
Figure 4:
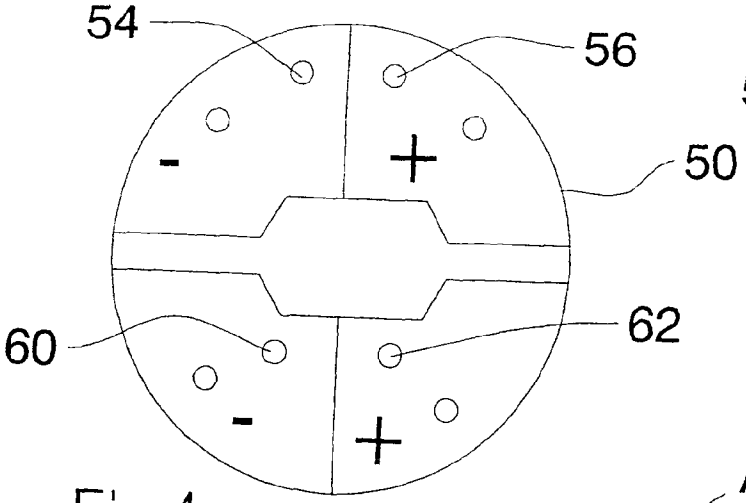
FIG. 4 is a bottom plan view of the circuit board.
Figure 3:
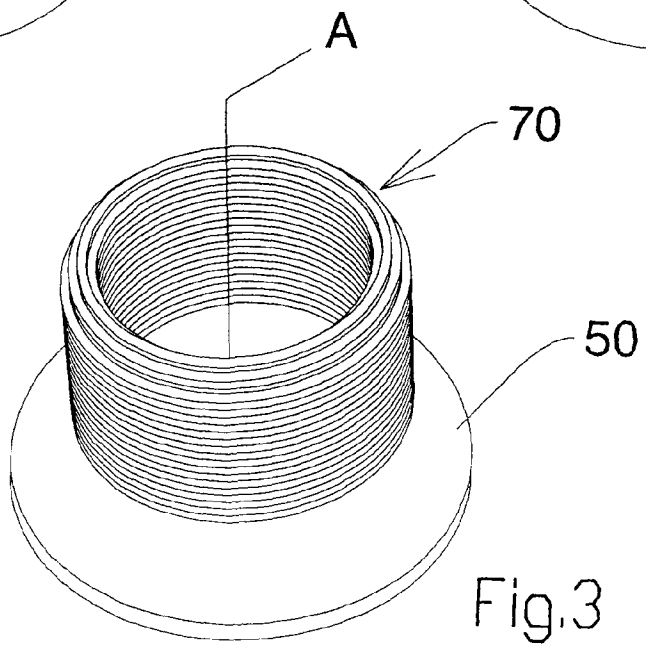
FIG. 3 is a perspective view of the bifilar circuit, mounted on a circular board.
Figure 6:
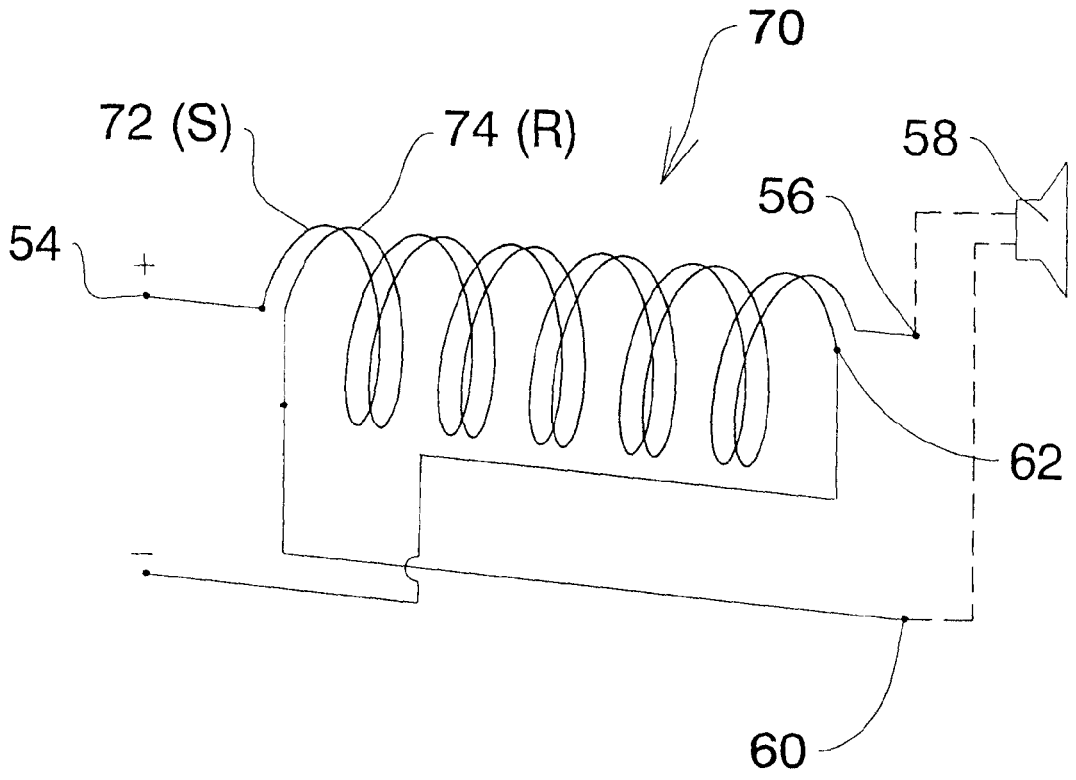
FIG. 6 is a schematic view of one bifilar coil unit, illustrating the first and second coils, with respective windings alternating with one another.

The circuit board (50) (FIGS. 3,4 & 5) comprises a single bifilar coil unit (52), having supply and return coils, indicated as 'S' and 'R' in FIG. 6. The coils are wound together in a bifilar manner as described in the U.S. patents noted above. The bifilar coil unit (52) defines a central axis normal to circuit board (50).

The supply coil (S) has an input supply connection (54) and an output supply connection (56). The input connection (54) is connected to one side of the incoming cable (18).

The output connection (56) is connected to one side of a speaker (58).

The return coil (R) has a input return connection (60) and an output return connection (62). The input return connection (60) is connected to the other terminal of the speaker (58). The output return connection (62) of the return coil is connected to the ground conductor of the cable (18). In this way, signals coming in via cable (18), from a signal source, will pass first through the supply coil (S), and then through the speaker (58) and then return from the speaker (58) through the return coil (R) to the ground conductor of the cable (18).

The effect of the passage of signals through the supply coil, the speaker and the return coil is such that unwanted noise signals which might be generated in a conventional circuit are substantially suppressed and the quality of sound heard by the user is greatly improved.

The circuit board (50) is approximately 0.125 inches in thickness and approximately 0.3 inches in width and is of generally circular-disc shape. These dimensions are found to be suitable for the restricted space within the interior of the earbud body (30) forming supply coil (S) and return coil (R).

The circuit board defines forward and rear sides. The forward side is directed towards the speaker, and the rear side is directed towards the signal cable (18) and the centre of the disk is aligned with the central axis of the housing.

The disk lies in a plane normal to the axis of the housing.

A bifilar coil unit (70), which is located on the forward side of the circuit board (50), is shown in FIG. 6. It has two wires (72) and (74). The effect of the bifilar winding of the wires in the coil unit is to produce a supply coil (S) and a return coil (R). The windings of the two coils are wound side by side. The input signal from cable (18) is connected to the input supply terminal of the supply coil. The output (56) of the supply coil is connected to the input of the speaker (58). The return of the speaker is connected to the input (60) of the return coil at one end. The output end (62) the return coil is connected to the ground terminal on the circuit board (50). It will be seen that signals supplied to the input terminal from the cable (18), will pass first through the supply coil, and will then pass through the speaker, and then will return through the return coil, and pass to the ground terminal.

Due to the size constraints, obtaining full range undistorted audio performance in the earphone and canal speaker is challenging. Most are made with high voice coil resistance, this practice masks the distortion. However much of the audio information is lost across the resistance of the voice coil. To overcome this, low resistance voice coils are utilized resulting in a high level of accurate performance being achieved. A bifilar coil is connected between the input source and the speaker, and between the speaker and ground.

The method of connection is such that the magnetic fields in both sections of the bifilar coil are of like polarity thereby cancelling the inductive reactance and preventing the development of a magnetic field around the bifilar coils during the rise time of current. In the decline time, the circuit shuts down due to the decay time in the bifilar coils being in opposition to each other. This causes all fields to decay with no current flow in the bifilar coils and in the voice coil. Using this method, a low resistance voice coil along with good quality parts, performance can be achieved that rivals the highest quality home sound systems.

This produces a major improvement in sound quality. Lower frequency sounds are heard with far greater clarity, than with other systems.

The invention is also applicable to a single earbud and speaker, which has many applications.

The foregoing is a description of a preferred embodiment of the invention which is given here by way of example only. The invention is not to be taken as limited to any of the specific features as described, but comprehends all such variations that come within the scope of the appended claims.

The invention claimed is:

1. An earbud sound system for a small speaker system having a head set with at least one earbud with a speaker and characterised by;

an earbud housing body defining a hollow interior;

a circuit board within said housing body and having a signal cable with a signal input and a signal ground portion;

a bifilar coil unit comprising a supply coil and a return coil wound in a bifilar manner, mounted on said circuit board;

two supply coil connections and two return coil connections on said circuit board, for supporting the bifilar coil unit in a secure manner on said circuit board by securing said bifilar coil unit to respective said supply and return coil connections on said circuit board;

conductors in said circuit board connecting said supply coil connections and return coil connections to respective signal input and signal ground portions of said signal cable.

2. An earbud sound system as claimed in claim 1 wherein said circuit board defines a forward circuit board side and a rear circuit board side, with said signal supply connection and signal return connection arranged side by side on said forward circuit board side, and with said signal input and signal ground portions of said cable on said rear circuit board side.

3. An earbud sound system as claimed in claim 1 including:

a signal source, as a source of audio signals, said head set having left and right hand ear buds, with respective said ear bud housing bodies and left and right hand speakers, and a wire harness connecting said signal source and said head set.

4. An earbud sound system as claimed in claim 3 wherein said earbud housing bodies, are sized to fit within the ear canals of a user, each of the earbud housing bodies defining a hollow interior, and wherein a said circuit board is contained within each respective earbud housing body.

5. An earbud sound system as claimed in claim 4 wherein each said earbud housing body is formed as first and second body portions separate from one another to give access to the interior of each said housing and wherein a said circuit board is fitted within one said body portion, and wherein the other said body portion is secured to said one portion, thereby enclosing the circuit board.

6. An earbud sound system as claimed in claim 5 wherein each said earbud housing body is of cylindrical shape in section and wherein said circuit board is of circular disk shape, and fits within its respective housing, transversely of said housing interior, with the centre of the disk aligned with the central axis of the housing.

7. An earbud sound system as claimed in claim 6 wherein each said earbud housing body is formed as two components, each of cylindrical shape in section, and including a connecting lip on one said component, and a ridge on the other said component, said lip and said ridge being complementary and interfitting to join said components together.

8. An earbud sound system as claimed in claim 7 including a tube extending from one component, and an ear cushion fitted onto said tube, and said tube transmitting sound from a respective said speaker to the user.

9. An earbud sound system as claimed in claim 5 wherein said circuit board defines a forward circuit board side and a rear circuit board side, and wherein said forward circuit board side is directed towards said speaker, and wherein said bifilar coil unit is mounted on said forward circuit board side, and wherein said rear circuit board side is directed towards said signal cable.

* * * * *